United States Patent [19]

Cho et al.

[11] Patent Number: 4,636,182

[45] Date of Patent: Jan. 13, 1987

[54] FILTER MANUFACTURING METHOD FOR THE PRODUCTION OF PRE-FILTERS TO REMOVE HARMFUL SUBSTANCES IN CIGARETTE SMOKE BY USE OF PINE NEEDLES

[76] Inventors: Chu Hwan Cho; Gong In Lee, both of 202-19, Nonhyon-dong, Kangnam-Ku, Seoul, Rep. of Korea

[21] Appl. No.: 761,808

[22] Filed: Aug. 2, 1985

[51] Int. Cl.[4] ..... F16H 9/12

[52] U.S. Cl. ..... 493/39; 131/342; 493/42; 493/43; 493/44

[58] Field of Search ..... 493/39, 42, 43, 44, 493/47, 49, 46, 50; 55/528; 131/342

[56] References Cited

U.S. PATENT DOCUMENTS 4,124,033 11/1978 Zizka et al. ..... 131/342

*Primary Examiner*—Lowell A. Larson
*Assistant Examiner*—Robert Showalter
*Attorney, Agent, or Firm*—Wenderoth, Lind & Ponack

[57] ABSTRACT

A process of manufacturing a pre-filter for the filteration of harmful substances in cigarettes by using pine needles which have been steamed to eliminate the odor of the pine resin. The steamed pine needles then are dried in a shaded lot and formed into powder. A dough is made by mixing up fine powder crushed from the dried pine needles with water. The dough is then crushed into granular form and the pre-filter is obtained by forming the granules into a rod shape.

3 Claims, No Drawings

FILTER MANUFACTURING METHOD FOR THE PRODUCTION OF PRE-FILTERS TO REMOVE HARMFUL SUBSTANCES IN CIGARETTE SMOKE BY USE OF PINE NEEDLES

FIELD OF THE INVENTION

This invention relates to a method of manufacturing a filter for the filteration of harmful materials in cigarettes by use of pine needles in the filter. More particularly, this invention relates to the method of manufacturing a pre-filter which is inserted into and used in the front of the existing cigarette filter.

The term "pre-filter" therefore means a filter which is placed just in front of the existing filter of a cigarette.

DESCRIPTION OF THE PRIOR ART

It has been widely known that a filter substance may be built-in to the front or the middle of a cigarette under the existing technology so that the harmful objects, including tar, released during the combustion of a cigarette can be absorbed and filtered. However, the efficiency of the absorptive and filteration capacities of these conventional filters are unsatisfactory so far and thus, it is desirable to reduce the amount of the tar inhaled during smoking because this material is a cancer-causing substance.

SUMMARY OF THE INVENTION

According to the present invention, a novel idea, however, has been introduced to overcome the defects of conventional filters as pointed above. The purpose of this invention is to provide a manufacturing method of the pre-filter through which any harmful substance produced in the course of combustion of a cigarette, including tar, can be satisfactorily filtered.

In accordance with this invention, the pine needles are used as a material to produce said pre-filter. There are several steps to be taken in the process of the manufacturing the pre-filter, namely, a step in which the odor of pine resin is eliminated by steaming, a step in which fine powder is produced after drying the pines needles in a shaded lot and sorting them out, a step in which granular material is produced after steaming dough made by mixing the fine powder and water, and a final step in which the granular material is dried in a shaded lot and heated at a temperature of 80 to 90 degree Centigrade and formed into short rod shapes.

DESCRIPTION OF THE INVENTION

A detailed explanation of this invention will be set forth below in reference to an example of the present invention.

First of all, as the raw material used in the pre-filter of this invention, fresh pine needles are carefully selected.

The carefully selected pine needles are then steamed into suitable shape of a steamer using a 30% salted water solution to generate the steam, so as to eliminate the particular odor of pine leaves.

In the course of such steaming, the pine needles are steamed during a period of approximately 1 to 2 hours in an air-tight steamer and thereafter, steamed in an open steamer in place of the air-tight steamer.

The steamed pine needles are then dried in a shaded lot. In the course of drying, particular attention must be paid to prevent any possible foreign materials from invading and a sterilization treatment is carried out on the needles in a suitable manner.

After the step of steaming, the dried pine needles are crushed in a proper crusher and made into fine powder which is sorted out whereby fine powder in a particle size of 0.01–0.1 mm can be produced.

A dough is made by mixing these fine powders with water (10 W%), and thereafter, the dough is granulated in the conventional manner to produce a granular shaped material after the dough is dried in the shaded lot and further dried at a slightly elevated temperature of 80–90 degree Centigrade and finally the pre-filter is produced by by forming the granules into a rod shape.

The color of the pre-filter obtained through this method is green or a green-bean color and as a result of inserting this pre-filter into the front of an existing filter of a cigarette, it has been proven that 80–85% of the harmful materials associated with the cigarette smoke including tar, is absorbed by the filter and pre-filter and, the color of the pre-filter is changed into a dark-red-brown, which is caused by said harmful substances.

As a result of using such pre-filter, no unsatisfactory effects has been shown to be imparted to the human body by the cigarette smoke, rather, the pre-filter has the effect of protecting one against any harmful materials being taken in by the human body, particularly, those harmful materials exposed to the bronchus.

There is an alternative method according to the present invention wherein the said granules are directly scattered into the interior of an existing filter, rather than using a separate pre-filter.

What is claimed is:

1. A process for manufacturing a pre-filter for the filteration of harmful substances in cigarette smoke by use of treated pine needles in the filter which comprises applying steam to the needles to remove the odor of pine resin from the needles, drying the pine needles in a shaded lot, crushing the dried needles to form a fine powder, preparing a dough from said fine powder by mixing the powder with water, allowing the dough to dry, granulating the dried dough and formulating a rod shaped pre-filter therefrom.

2. A process according to claim 1, wherein the steam is applied in an air tight steamer for a period of about one to two hours followed by a steam treatment in an open steamer.

3. A process according to claim 1, wherein the thus produced pre-filter is inserted before the filter of a filtered cigarette to eliminate harmful substances produced during smoking.

* * * * *